US009375966B2

(12) United States Patent
Tan et al.

(10) Patent No.: US 9,375,966 B2
(45) Date of Patent: Jun. 28, 2016

(54) SENSITIZER PARTICLE DISPERSION FOR THERMOSENSITIVE RECORDING MEDIUM COMPOSED MAINLY OF STEARIC ACID AMIDE, PREPARATION METHOD THEREOF, MIXED DISPERSION COMPOSITION FOR THERMOSENSITIVE RECORDING LAYER, AND THERMOSENSITIVE RECORDING MEDIUM

(71) Applicant: Sanko Co., Ltd., Fukuoka (JP)

(72) Inventors: Tjangkie Tan, Osaka (JP); Yoshito Nakagawa, Osaka (JP)

(73) Assignee: Sanko Co., Ltd., Fukuoka (JP)

( * ) Notice: Subject to any disclaimer, the term of this patent is extended or adjusted under 35 U.S.C. 154(b) by 37 days.

(21) Appl. No.: 14/554,824

(22) Filed: Nov. 26, 2014

(65) Prior Publication Data

US 2015/0183252 A1 Jul. 2, 2015

(30) Foreign Application Priority Data

Dec. 27, 2013 (JP) ..... 2013-271547

(51) Int. Cl.
*B41M 5/337* (2006.01)

(52) U.S. Cl.
CPC ..... *B41M 5/3375* (2013.01)

(58) Field of Classification Search
CPC ..... B41M 5/337; B41M 5/3375
USPC ..... 503/208, 209
See application file for complete search history.

(56) References Cited

U.S. PATENT DOCUMENTS

2002/0061819 A1* 5/2002 Ohno ..... B41M 5/3336 503/216

FOREIGN PATENT DOCUMENTS

| | | | |
|---|---|---|---|
| JP | 56005791 | A | 1/1981 |
| JP | H05168965 | A | 7/1993 |
| JP | 2002079074 | A | 3/2002 |

* cited by examiner

*Primary Examiner* — Bruce H Hess
(74) *Attorney, Agent, or Firm* — Drinker Biddle & Reath LLP

(57) ABSTRACT

A sensitizer particle dispersion containing stearic acid amide, a preparation method thereof, a mixed dispersion composition for a thermosensitive recording layer using the sensitizer particle dispersion, and a thermosensitive recording medium using the mixed dispersion composition are provided. The sensitizer particle dispersion can be safely prepared under atmospheric pressure by mixing stearic acid amide and another sensitizer at a mass ratio of 95:5~51:49; co-melting the mixture by heat in emulsifier-dispersed water, whereby the mixture is unified and emulsified into particles, or emulsifying the co-melted mixture of stearic acid amide and the other sensitizer unified by co-melting the mixture by heat, into particles in emulsifier-dispersed water; and quenching the obtained emulsified dispersion, thus crystallizing sensitizer particles from the emulsified particles.

8 Claims, No Drawings

SENSITIZER PARTICLE DISPERSION FOR THERMOSENSITIVE RECORDING MEDIUM COMPOSED MAINLY OF STEARIC ACID AMIDE, PREPARATION METHOD THEREOF, MIXED DISPERSION COMPOSITION FOR THERMOSENSITIVE RECORDING LAYER, AND THERMOSENSITIVE RECORDING MEDIUM

CROSS REFERENCE TO RELATED APPLICATION

This application claims the benefit of Japanese Patent Application No. JP 2013-271547, filed Dec. 27, 2013, which is hereby incorporated by reference in its entirety into this application.

BACKGROUND OF THE INVENTION

1. Technical Field

The present invention relates to a method of preparing a sensitizer particle dispersion for a thermosensitive recording medium composed mainly of stearic acid amide, a sensitizer particle dispersion prepared thereby, a mixed dispersion composition for a thermosensitive recording layer using the sensitizer particle dispersion, and a thermosensitive recording medium using the mixed dispersion composition.

2. Description of the Related Art

A thermosensitive recording medium, which makes use of the color-developing reaction of a dye, a color developer and a sensitizer induced by heat, is inexpensive, and is thus useful in facsimile systems, printers, etc. and widely utilized in labels, tickets and so on.

A typical thermosensitive recording medium is manufactured by applying a composition containing an electron donating dye, an electron accepting color developer, etc. on a support such as paper, a film, etc. and then drying it. When the surface of the layer thus applied (which is a thermosensitive recording layer) is subjected to Joule heating from a thermal head, the dye and the color developer, which are distributed in the applied layer, are melt-reacted, thus forming a color developed phase.

However, a commercially available thermosensitive recording medium may include, in addition to the dye and the color developer, a sensitizer (a recording sensitivity improver) for increasing heat response to achieve high-speed recording and low energy consumption (energy saving).

Examples of the sensitizer may include stearic acid amide, 1,2-bis(phenoxy)ethane, 1,2-bis(3-methylphenoxy)ethane, 1,2-bis(4-methylphenoxy)ethane, p-benzylbiphenyl, di-p-methylbenzyl oxalate, β-naphthylbenzylether, diphenylsulfone, waxes, etc.

When the sensitizer is contained in the thermosensitive recording layer, it is distributed in the form of particles. As the size of the particles thereof is reduced, the sensitizer may exhibit superior heat melting properties and may thus effectively function.

As such, the sensitizer having a small particle diameter may be contained in the thermosensitive recording layer in such a manner that a sensitizer, which was previously made in the form of particles, is dispersed in a thermosensitive recording layer, or that a sensitizer is finely milled to an average particle diameter of 0.40 μm, 0.25 μm or 0.10 μm together with a dye or a color developer using a sand grinder (a wet-mill), etc. and is then contained in the thermosensitive recording layer (Patent Document 1).

However, at present the average particle diameter of the sensitizer contained in the thermosensitive recording layer and provided practically falls in the range of about 1~3 μm. This is because particles having a particle diameter of 1 μm or less have to be made using a specific particle forming device and the formation thereof requires high energy and long treatment time, undesirably resulting in high treatment costs.

Particularly useful as the sensitizer, stearic acid amide is employed in general-grade thermosensitive recording media because it is cheap. It is also known to manifest excellent functionality as a sensitizer for a thermosensitive recording medium containing 4,4'-dihydroxydiphenylsulfone as a color developer.

In order for the thermosensitive recording medium to develop high-sensitivity color even in the low energy range, the dye and the color developer in particle form distributed in the thermosensitive recording layer have to be instantly melt-reacted. To this end, however, stearic acid amide having a melting point of 102° C., which acts as a solvent for a dye and a color developer, should have a small particle diameter (e.g. 1 μm or less) to increase heat melting properties.

As for the reduction in the particle diameter of stearic acid amide to form stearic acid amide particles, the use of a sand grinder (a wet-mill) is disclosed. However, this method is inefficient and is not profitable because a long period of time is required to form stearic acid amide particles and also because the resulting dispersion has an unsatisfactory concentration of about 10% (Patent Document 2).

Furthermore, as for the reduction in the particle diameter of stearic acid amide, emulsifying stearic acid amide to form an emulsion thereof is disclosed (Patent Document 3).

According to this method, water, stearic acid amide and an emulsifier are placed in a pressure vessel, heated to 100° C. or more (e.g. 120° C.) and then processed at a pressure of 20 MPa using a high-pressure homogenizer, and thereby stearic acid amide may be provided in the form of an emulsion containing fine and uniform particles having an average particle diameter of 0.7 μm or less with good stability.

CITATION LIST

Patent Literature

Japanese Patent Application Publication No. 1993-168965
Japanese Patent Application Publication No. 1981-5791
Japanese Patent Application Publication No. 2002-79074

SUMMARY OF THE INVENTION

However, the method disclosed in Patent Document 3 needs high-pressure treatment using a pressure vessel because the melting point of stearic acid amide is 102° C. Since water is boiled at about 100° C. under atmospheric pressure and then its temperature is not further increased, a high pressure of 20 MPa is set so that the boiling point of water is 100° C. or more to dissolve stearic acid amide in water.

As mentioned above, the method disclosed in Patent Document 3 is problematic in terms of the use of a specific pressure-resistant device such as a pressure vessel, high difficulty in the treatment process, the need for device maintenance or work safety. Hence, the method involving dangerous work with high device cost is not industrially applicable.

Accordingly, the present invention has been made keeping in mind the problems encountered in the related art, and an object of the present invention is to provide a method of preparing a sensitizer particle dispersion, wherein processes may be safely performed under atmospheric pressure despite the use of stearic acid amide as a sensitizer and which obviates statutory maintenance obligations; a sensitizer particle dispersion prepared by the method; a mixed dispersion composition for a thermosensitive recording layer using the sensitizer particle dispersion; and a thermosensitive recording medium using the mixed dispersion composition.

The present inventors have carried out intensive and thorough research to solve the problems encountered in the related art, resulting in the finding that even when a mixture of stearic acid amide and another sensitizer is co-melted to form particles under mild conditions of a temperature equal to or less than the boiling point of water and atmospheric pressure (0.1 MPa), a sensitizer particle dispersion composed mainly of stearic acid amide, able to exhibit sufficient color-developing sensitivity, may be obtained, thereby culminating in the present invention.

In order to accomplish the above object, the present invention provides a method of preparing a sensitizer particle dispersion for a thermosensitive recording medium composed mainly of stearic acid amide, comprising: mixing stearic acid amide with another sensitizer other than stearic acid amide, at least one selected from the group consisting of 1,2-bis(phenoxy)ethane, 1,2-bis(3-methylphenoxy)ethane, 1,2-bis(4-methylphenoxy)ethane, p-benzylbiphenyl, di-p-methylbenzyl oxalate, β-naphthylbenzylether and diphenylsulfone at a mass ratio of 95:5~51:49, thus obtaining a mixture; co-melting the obtained mixture by heat in emulsifier-dispersed water, so that the stearic acid amide and the other sensitizer are unified and emulsified into particles, or emulsifying a co-melted mixture of the stearic acid amide and the other sensitizer unified by co-melting the mixture by heat, into particles in emulsifier-dispersed water, thus obtaining an emulsified dispersion; and quenching the emulsified dispersion, thus crystallizing sensitizer particles from the emulsified particles.

In the method of preparing of the present invention, the quenched emulsified dispersion preferably has a temperature of 50° C. or less.

In addition, the present invention provides a sensitizer particle dispersion for a thermosensitive recording medium composed mainly of stearic acid amide, characterized in that it is prepared by the method as above.

In addition, the present invention provides a mixed dispersion composition for a thermosensitive recording layer, characterized in that it comprises the sensitizer particle dispersion as above, a dye for a thermosensitive recording medium, and a color developer for a thermosensitive recording medium, which are mixed together.

The mixed dispersion composition for a thermosensitive recording layer of the present invention may be configured such that a first mixed dispersion obtained by mixing the sensitizer particle dispersion as above and the dye for a thermosensitive recording medium and performing wet-milling, is mixed with a wet-milled dispersion of the color developer for a thermosensitive recording medium.

The mixed dispersion composition for a thermosensitive recording layer of the present invention may be configured such that a second mixed dispersion obtained by mixing the sensitizer particle dispersion as above and the color developer for a thermosensitive recording medium and performing wet-milling, is mixed with a wet-milled dispersion of the dye for a thermosensitive recording medium.

The mixed dispersion composition for a thermosensitive recording layer of the present invention may be configured such that a first mixed dispersion obtained by mixing the sensitizer particle dispersion as above and the dye for a thermosensitive recording medium and performing wet-milling, is mixed with a second mixed dispersion obtained by mixing the sensitizer particle dispersion as above and the color developer for a thermosensitive recording medium and performing wet-milling.

In addition, the present invention provides a thermosensitive recording medium, characterized in that it comprises a thermosensitive recording layer formed by applying the mixed dispersion composition as above on a support.

According to the present invention, there can be provided a method of preparing a sensitizer particle dispersion composed mainly of stearic acid amide, wherein the sensitizer particle dispersion composed mainly of stearic acid amide can be safely and rapidly produced under mild conditions of a temperature equal to or less than the boiling point of water and atmospheric pressure (0.1 MPa) as well as a lowered melting point of stearic acid amide, without the use of any means such as a pressure vessel, a high-pressure (e.g. 20 MPa) or the like, despite the use of stearic acid amide as a sensitizer; a sensitizer particle dispersion prepared by the method; a mixed dispersion composition for a thermosensitive recording layer using the sensitizer particle dispersion; and a thermosensitive recording medium using the mixed dispersion composition.

DESCRIPTION OF THE SPECIFIC EMBODIMENTS

<Method of Preparing Sensitizer Particle Dispersion for Thermosensitive Recording Medium Composed Mainly of Stearic Acid Amide>

According to the present invention, a method of preparing a sensitizer particle dispersion for a thermosensitive recording medium composed mainly of stearic acid amide (hereinafter also abbreviated to 「sensitizer particle dispersion」) comprises: mixing stearic acid amide with another sensitizer other than the stearic acid amide (hereinafter also abbreviated to 「the other sensitizer」), at least one selected from the group consisting of 1,2-bis(phenoxy)ethane, 1,2-bis(3-methylphenoxy)ethane, 1,2-bis(4-methylphenoxy)ethane, p-benzylbiphenyl, di-p-methylbenzyl oxalate, β-naphthylbenzylether and diphenylsulfone at a mass ratio of 95:5~51:49, thus obtaining a mixture; co-melting the obtained mixture by heat in emulsifier-dispersed water, so that stearic acid amide and the other sensitizer are unified and emulsified into particles, or emulsifying a co-melted mixture of the stearic acid amide and the other sensitizer unified by co-melting the mixture by heat, into particles in emulsifier-dispersed water, thus obtaining an emulsified dispersion; and quenching the emulsified dispersion, thus crystallizing sensitizer particles from the emulsified particles.

In an embodiment of the present invention, unification of the sensitizer, emulsification into particles of the sensitizer, and crystallization of the sensitizer particles via quenching of the emulsified dispersion are regarded as important.

In this embodiment, a stearic acid amide, which is a sensitizer having a melting point of 102° C., is used in combination with the other sensitizer. The sensitizer unified by co-melting them may have a lowered melting point due to the melting point drop effect, and may be formed into emulsified particles even under mild conditions of a temperature equal to or less than the boiling point of water and atmospheric pressure (0.1 MPa). Further, by quenching the emulsified dispersion including the emulsified particles, crystals of sensitizer particles composed mainly of stearic acid amide with a sufficiently small average particle diameter may be obtained.

According to the embodiment of the present invention, the sensitizer particle dispersion may be safely and rapidly obtained in the absence of high pressure (e.g. 20 MPa) treatment, without involving statutory maintenance obligations.

The other sensitizer may be used alone or in combination of two or more.

The melting points (mp) of stearic acid amide and the other sensitizer are described below: stearic acid amide (mp 102° C.), 1,2-bis(phenoxy)ethane (mp 96° C.), 1,2-bis(3-methylphenoxy)ethane (mp 98° C.), 1,2-bis(4-methylphenoxy) ethane (mp 125° C.), p-benzylbiphenyl (mp 86° C.), di-p-methylbenzyl oxalate (mp 103° C.), β-naphthylbenzylether (mp 101° C.), and diphenylsulfone (mp 123° C.).

Examples of the melting point of the sensitizer unified by co-melting stearic acid amide and the other sensitizer are shown below.

When 70 mass parts of stearic acid amide and 30 mass parts of 1,2-bis(phenoxy)ethane are co-melted and crystallized, such crystals have a melting point of 94.2° C.

When 70 mass parts of stearic acid amide and 30 mass parts of 1,2-bis(3-methylphenoxy)ethane are co-melted and crystallized, such crystals have a melting point of 95.5° C.

When 80 mass parts of stearic acid amide and 20 mass parts of 1,2-bis(4-methylphenoxy)ethane are co-melted and crystallized, such crystals have a melting point of 99.9° C.

When 90 mass parts of stearic acid amide and 10 mass parts of p-benzylbiphenyl are co-melted and crystallized, such crystals have a melting point of 99.4° C.

When 70 mass parts of stearic acid amide and 30 mass parts of di-p-methylbenzyl oxalate are co-melted and crystallized, such crystals have a melting point of 97.8° C.

When 70 mass parts of stearic acid amide and 30 mass parts of β-naphthylbenzylether are co-melted and crystallized, such crystals have a melting point of 95.8° C.

When 70 mass parts of stearic acid amide and 30 mass parts of diphenylsulfone are co-melted and crystallized, such crystals have a melting point of 98.9° C.

As such, the melting point (102° C.) of stearic acid amide may be lowered to 100° C. or less by co-melting with the other sensitizer.

In this embodiment, stearic acid amide as a main component of the sensitizer, and the other sensitizer as a sub-component of the sensitizer are mixed at a mass ratio of [stearic acid amide]:[the other sensitizer]=95:5~51:49. If the mixing proportion of the other sensitizer is less than 5 mass parts, the melting point of the unified sensitizer cannot be lowered to 100° C. or less. In addition, if the mixing proportion of the other sensitizer exceeds 49 mass parts, desired properties due to the use of stearic acid amide in the unified sensitizer cannot be obtained.

In this embodiment, stearic acid amide and the other sensitizer are mixed at the above mass ratio and then the obtained mixture is co-melted by heat in the emulsifier-dispersed water, whereby stearic acid amide and the other sensitizer are unified and emulsified into particles, resulting in an emulsified dispersion. Also, in this embodiment, the emulsified dispersion may be obtained in such a manner that stearic acid amide and the other sensitizer are mixed at the above mass ratio, the obtained mixture is co-melted by heat to unify the stearic acid amide and the other sensitizer, and the co-melted mixture is emulsified into particles in emulsifier-dispersed water. In the case where the co-melted mixture is emulsified into particles in the emulsifier-dispersed water, when the temperature of the emulsifier-dispersed water is sufficiently high, the co-melted mixture may be instantly emulsified into particles. On the other hand, when the temperature of the emulsifier-dispersed water is lower than a predetermined temperature, the co-melted mixture may be crystallized in the emulsifier-dispersed water. However, when this state of the emulsifier-dispersed water is heated and the crystals are thus co-melted by heat, the emulsified dispersion may be obtained.

As used herein, 「co-melting」 means that the mixture is melted, unless otherwise stated. Also, 「unification」 means the state that the co-melted mixture is mixed uniformly in a molecular level.

In this embodiment, in order for stearic acid amide and the other sensitizer to be unified and emulsified into particles in emulsifier-dispersed water, co-melting by heat is carried out at a temperature equal to or lower than the boiling point of water under atmospheric pressure (0.1 MPa). Co-melting by heat may be conducted at a different pressure, for example, a pressure higher than atmospheric pressure (e.g. in the pressure range of higher than 0.1 MPa but less than 1 MPa). However, co-melting by heat may be preferably carried out at a temperature equal to or lower than the boiling point (100° C.) of water under atmospheric pressure (0.1 MPa) because the process is relatively easily performed under safe conditions by avoiding the high-pressure treatment.

According to this embodiment, even when the sensitizer particle dispersion includes sensitizer particles having, for example, an average particle diameter of 1.0~1.5 μm, the resulting thermosensitive recording medium may exhibit color-developing sensitivity equal to or superior to when using conventional sensitizer particles comprising stearic acid amide with an average particle diameter of about 0.5 μm smaller than the above average particle diameter, as will be described in the following examples.

The reason is assumed to be because stearic acid amide and the other sensitizer are unified in a molecular level by co-melting by heat, and thus each of the emulsified particles thereof may be easily melted at a lower temperature due to the melting point drop effect, thereby enhancing functionality as the sensitizer, i.e. as a solvent which facilitates the instant and easy melting of a dye and a color developer.

In this embodiment, in order to exhibit superior color-developing sensitivity of a thermosensitive recording medium, the sensitizer particles of the sensitizer particle dispersion have an average particle diameter of preferably 1.0 μm or less, and more preferably 0.5 μm or less.

As used herein, 「average particle diameter」 refers to 「a particle diameter of 50% cumulative fine particles in a cumulative particle size distribution curve」, i.e. 「$D_{50}$」 unless otherwise stated.

The emulsifier-dispersed water is used for the emulsification into particles, and may be obtained by mixing an emulsifying dispersant and water.

The emulsifying dispersant may include those known in the art, and is preferably exemplified by polysulfonate, sodium polyacrylate, polyvinylalcohol (having various degrees of saponification and polymerization, and pH values, as obtained by a variety of modification processes), alkylsulfate ester, dialkyl sulfosuccinate, polyoxyethylene alkylsulfate ester, polyoxyalkylene alkylether, polyoxyalkylene alkylphenylether, etc.

The emulsifying dispersant may be used alone or in combination of two or more.

The emulsifying dispersant may be used in an amount of preferably 0.01~16 mass %, and more preferably 0.05~8 mass %, based on the total amount of the sensitizer (the sum of stearic acid amide and the other sensitizer). When the amount of the emulsifying dispersant is equal to or more than the above lower limit, an emulsification dispersing process may be sufficiently carried out. On the other hand, when the amount of the emulsifying dispersant is equal to or less than the above upper limit, foaming of the mixed dispersion may be suppressed, thus improving water resistance of the thermosensitive recording medium.

The mixed dispersion of the mixture obtained by mixing stearic acid amide and the other sensitizer, or the co-melted mixture obtained by co-melting the mixture by heat, and the emulsifier-dispersed water, preferably has a solid content of 10~50 mass %. When the solid content is 10 mass % or more, treatment efficiency may be improved thus generating economic benefits. On the other hand, when the solid content is 50 mass % or less, phase reversal in the emulsion system is suppressed.

A device for use in unification and emulsification into particles of the sensitizer may include (1) a high-speed revolution type emulsifying device such as homomixer type, comb teeth type or intermittent jet stream generation type, (2) a colloid mill type emulsifying device, (3) a high-speed emulsifying device, (4) a roll mill type emulsifying device, (5) a sonication type emulsifying device, (6) a membrane type emulsifying device, combinations thereof, etc.

The emulsified particles obtained by emulsification into particles of the sensitizer have an average particle diameter of preferably 3.0 μm or less, more preferably 1.5 μm or less, and still more preferably 0.5 μm or less. When the average particle diameter of the emulsified particles is equal to or less than the upper limit, sensitizer particles having sufficient functionality are obtained. Further, a reduction in the average particle diameter thereof may result in sensitizer particles with highly improved color-developing sensitivity in the thermosensitive recording medium.

When the sensitizer is emulsified into particles, the mixing sequence of individual components is not limited. For example, stearic acid amide, the other sensitizer, the emulsifying dispersant and water may be mixed simultaneously or in any sequence, and stearic acid amide and the other sensitizer may be co-melted by heat, thereby ensuring the effects of the invention. In order to more significantly attain the effects of the invention, the mixture of stearic acid amide and the other sensitizer may be co-melted by heat in the emulsifier-dispersed water to emulsify into particles, or the co-melted mixture unified by co-melting the mixture by heat may be emulsified into particles in the emulsifier-dispersed water.

In this embodiment, the emulsified dispersion is quenched, whereby the sensitizer particles are crystallized from the emulsified particles. In this case, the sensitizer particle dispersion having good fluidity without breaking the emulsified state thereof may be obtained. Furthermore, the sensitizer particle dispersion thus obtained is superior in terms of long-term storage stability.

In contrast, when the emulsified dispersion is cooled using any process except for the quenching process, the sensitizer particles may be grown into, for example, a large crystalline material having a maximum diameter of tens of μm, making it impossible to sufficiently exhibit functionality as the sensitizer and deteriorating the storage stability.

When quenching the emulsified dispersion, the cooling rate is preferably 3° C./min or more, more preferably 6° C./min or more and still more preferably 10° C./min or more. As used herein, 「cooling rate of 3° C./min or more」 means that the temperature is lowered at a rate of 3° C. or more per min (e.g. a rate of 4° C. per min).

The emulsified dispersion may be quenched with or without a different component. When it is mixed with the different component, the emulsified dispersion may be quenched by mixing with the cooled different component. The emulsified dispersion is instantly cooled due to the contact with the different component that is sufficiently cooled, and is thus quenched as in the quenching process of the emulsified dispersion without mixing the different component.

The different component is not particularly limited so long as it does not retard the effects of the invention, and may be exemplified by water (including ice), an emulsifying dispersant, the emulsified dispersion as above, etc.

The different component may be used alone or in combination of two or more. Preferably useful is cold water, ice water, or emulsifier-dispersed water comprising it and the emulsified dispersion.

When the emulsified dispersion is quenched using a coolant, etc., any known process may be applied. For example, quenching may be performed using a device equipped with a heat exchanger on the path, through which the emulsified dispersion passes.

<Sensitizer Particle Dispersion for Thermosensitive Recording Medium Composed Mainly of Stearic Acid Amide>

According to the present invention, the sensitizer particle dispersion for a thermosensitive recording medium composed mainly of stearic acid amide (the sensitizer particle dispersion) is characterized in that it is obtained by the preparation method according to the present invention as above.

In the sensitizer particle dispersion, the sensitizer particles have an average particle diameter of preferably 1.8 μm or less, and more preferably 1.6 μm or less. Within this range, color-developing sensitivity in the thermosensitive recording medium is further improved. The lower limit of the average particle diameter of the sensitizer particles is not particularly limited so long as it does not retard the effects of the present invention.

In the sensitizer particle dispersion, the sensitizer particles comprise stearic acid amide and the other sensitizer, which are unified by co-melting by heat, and thus these particles are different from conventional sensitizer particles, such as, a simple mixture of stearic acid amide and the other sensitizer without performing co-melting by heat, etc. For example, when carrying out the measurement by differential scanning calorimetry (DSC), only one main peak showing the melting point is observed in the sensitizer particles according to the present invention, whereas two or more main peaks showing the melting points are generally observed in the sensitizer particles of the simple mixture. Specifically, the peaks corresponding to the number of components in the simple mixture are observed, or a wide peak, which is regarded as overlap of a plurality of these peaks, is observed.

<Mixed Dispersion Composition for Thermosensitive Recording Layer>

According to the present invention, a mixed dispersion composition for a thermosensitive recording layer (hereinafter also abbreviated to 「mixed dispersion composition」) includes the sensitizer particle dispersion according to the present invention as above, a dye for a thermosensitive recording medium (hereinafter also abbreviated to 「dye」) and a color developer for a thermosensitive recording medium (hereinafter also abbreviated to 「color developer」), which are mixed together.

The dye is a leuco dye as will be described later, and is not limited so long as it is known in the art. Preferably, the dye is provided in the form of particles, especially wet-milled particles.

The color developer is not limited so long as it is known in the art, and is preferably provided in the form of particles, especially wet-milled particles.

A mill for use in formation of particles of the dye and the color developer may include, for example, a sand grinder (a sand mill).

Finely dispersing the dye and the color developer using a wet-mill may be performed in such a manner that the dye and the color developer may be separately wet-milled, the sensitizer particle dispersion and the dye may be mixed and then wet-milled, or the sensitizer particle dispersion and the color developer may be mixed and then wet-milled.

According to the present invention, the mixed dispersion composition may be preferably configured such that a first mixed dispersion obtained by mixing and wet-milling the sensitizer particle dispersion and the dye, is mixed with a wet-milled color developer dispersion.

Also, according to the present invention, the mixed dispersion composition may be preferably configured such that a second mixed dispersion obtained by mixing and wet-milling the sensitizer particle dispersion and the color developer, is mixed with a wet-milled dye dispersion.

Also, according to the present invention, the mixed dispersion composition may include the first mixed dispersion and the second mixed dispersion, which are mixed together.

The dye is preferably exemplified by a fluoran compound, an indolylphthalide compound, a divinylphthalide compound, a pyridine compound, a spiro compound, a fluorene compound, a triarylmethane compound, a diarylmethane compound, etc. More specific examples thereof may include 3-N,N-dibutylamino-6-methyl-7-anilinofluoran, 3-N,N-diethylamino-6-methyl-7-anilinofluoran, 3-N,N-diamylamino-6-methyl-7-anilinofluoran, 3-N,N-diethylamino-7-(m-trifluoromethylanilino)fluoran, 3-(N-isoamyl-N-ethyl)amino-6-methyl-7-anilinofluoran, 3-(N-p-tolyl-N-ethyl)amino-6-methyl-7-anilinofluoran, 3-(N-isopentyl-N-ethyl)amino-6-methyl-7-anilinofluoran, 3-(N-cyclohexyl-N-methyl)amino-6-methyl-7-anilinofluoran, 3-N,N-diethylamino-6-chloro-7-anilinofluoran, and 3,3-bis(4-dimethylaminophenyl)-6-dimethylaminopthalide. When such a dye is combined with the sensitizer and the color developer, superior color-developing properties may result. The dye may be used alone or in combination of two or more.

In the mixed dispersion composition, the dye is used in an amount of preferably 10~500 mass parts, more preferably 20~400 mass parts, and still more preferably 30~200 mass parts, based on 100 mass parts of the sensitizer (including stearic acid amide and the other sensitizer).

When the amount of the dye is equal to or more than the lower limit, color-developing sensitivity in the thermosensitive recording medium may be further improved. On the other hand, when the amount of the dye is equal to or less than the upper limit, excessive use thereof is suppressed.

The color developer preferably includes a phenolic compound, a sulfonic compound, a sulfuric compound, a nitrogenous compound, a salicylic acid-type compound, etc. Specific examples thereof may include 4,4'-dihydroxydiphenylsulfone, 2,4'-dihydroxydiphenylsulfone, 4-hydroxy-4'-isopropoxydiphenylsulfone, bis(3-aryl-4-hydroxyphenyl)sulfone, 2,2-bis(4-hydroxyphenyl)propane, bis(4-hydroxyphenylthioethoxy)methoxy)methane, bis(4-hydroxyphenylthioethyl) ether, 4,4'-cyclohexylidenediphenol, 4-benzyloxy-4'-hydroxydiphenylsulfone, 4-aryloxy-4'-hydroxydiphenylsulfone, p-hydroxybenzyl benzoate, 3,5-di(α-methylbenzyl)salicylic acid and zinc salts thereof, 2,4-bis(phenylsulfonyl)phenol, 2,4-bis(phenylsulfonyl)-5-methylphenol, 4-hydroxybenzene sulfoanilide, a reaction mixture of toluene diisocyanate, diaminodiphenylsulfone and phenol, 4,4'-bis(p-toluenesulfonyl aminocarbonyl amino)-diphenylmethane, p-toluenesulfonylamino carbanilide, α,α'-bis {4-(p-hydroxyphenylsulfone)phenoxy}-p-xylene, a dehydration condensate of a 2,2-bis(hydroxymethyl)-1,3-propanediol polycondensate and 4-hydroxybenzoic acid, and 4,4'-{oxybis(ethyleneoxide-p-phenylenesulfonyl)}diphenol. When such a color developer is combined with the sensitizer and the dye, color-developing properties may become superior.

The color developer may be used alone or in combination of two or more.

As for the mixed dispersion composition, the color developer is used in an amount of preferably 10~500 mass parts, more preferably 30~400 mass parts, and still more preferably 50~300 mass parts, based on 100 mass parts of the sensitizer (including stearic acid amide and the other sensitizer).

When the amount of the color developer is equal to or more than the lower limit, color-developing sensitivity in the thermosensitive recording medium is further improved. On the other hand, when the amount of the color developer is equal to or less than the upper limit, excessive use thereof is suppressed.

In this embodiment, the sensitizer particle dispersion, which is mixed with the dye and the color developer, may be diluted with a solvent such as water, etc. For example, the sensitizer particle dispersion obtained by the preparation method as above may be diluted so that its solid content is preferably 17~23 mass %, and more preferably 18.5~21.5 mass %.

Furthermore, the first or the second mixed dispersion, which is mixed with the dye or the color developer, may be diluted with a solvent such as water, etc. For example, the first or the second mixed dispersion thus obtained may be diluted so that its solid content is preferably 10~45 mass %, and more preferably 15~42 mass %.

According to the present invention, the mixed dispersion composition may include a different component, as well as the sensitizer particle dispersion, the dye and the color developer.

In the mixed dispersion composition, the different component may include a pigment, an adhesive, a light resistance improver, a water resistance improver, metallic soap, wax, a surfactant, a defoaming agent, a dispersant, etc.

Specifically, the pigment functions to prevent the attachment of residue to a recording head, and to further increase whiteness of the thermosensitive recording layer for a thermosensitive recording medium obtained by using the mixed dispersion composition, and may include those known in the art. Examples thereof may include inorganic powder such as kaolin, silica, amorphous silica, calcined kaolin, zinc oxide, calcium carbonate, aluminum hydroxide, magnesium hydroxide, magnesium carbonate, magnesium oxide, titanium oxide, barium sulfate, synthetic aluminum silicate, etc.; and organic resin powder such as styrene-methacrylic acid copolymer, polystyrene resin and urea-formalin resin, etc.

The pigment may be used alone or in combination of two or more.

In the mixed dispersion composition, the pigment is used in an amount of preferably 10~2000 mass parts, and more preferably 20~1000 mass parts, based on 100 mass parts of the dye.

When the amount of the pigment is equal to or more than the lower limit, the effects due to the use of the pigment may become significant. On the other hand, when the amount of the pigment is equal to or less than the upper limit, color-developing sensitivity in the thermosensitive recording medium is further improved.

The adhesive may include either water-soluble resin or water-dispersible resin. Examples thereof may include water-soluble resins, such as completely (or partially) saponified polyvinylalcohol, acetoacetyl group-modified polyvinylalcohol, carboxyl group-modified polyvinylalcohol, silicon-modified polyvinylalcohol, butyral-modified polyvinylalcohol, sulfonic acid group-modified polyvinylalcohol, polyvinylpyrrolidone, starch and derivatives thereof, Arabia rubber, gelatin, casein, chitosan, methylcellulose, methoxycellulose, hydroxyethylcellulose, carboxymethylcellulose, hydroxymethylcellulose, sodium carboxymethylcellulose, styrene-acrylic acid copolymer salts, styrene-maleic anhydride copolymer salts, methylvinylether-maleic anhydride copolymer salts, isopropylene-maleic anhydride copolymer salts, etc.; and water-dispersible resins, such as vinylacetate-type latex, acrylic acid ester copolymer-type latex, methacrylic acid ester copolymer-type latex, vinylacetate-(meth) acrylic acid ester copolymer-type latex, polyurethane-type latex, polyvinylchloride-type latex, polyvinylidene chloride-type latex, styrene-butadiene-type latex, etc.

As used herein, 「(meth)acrylic acid」 refers to both of 「acrylic acid」 and 「methacrylic acid」.

The adhesive may be used alone or in combination of two or more.

In the mixed dispersion composition, the adhesive is used in an amount of preferably 2~40 mass %, and more preferably 5~30 mass %, based on the total amount of solid content in the thermosensitive recording layer.

When the amount of the adhesive is equal to or more than the lower limit, the effects due to the use of the adhesive may become significant. On the other hand, when the amount of the adhesive is equal to or less than the upper limit, color-developing sensitivity in the thermosensitive recording medium is further improved.

The metallic soap and the wax are used so as to prevent sticking of the thermosensitive recording medium upon contact with a recording device or a recording head, and may include those known in the art. Examples thereof may include high-grade fatty acid metal salts, such as zinc stearate, calcium stearate, aluminum stearate, etc.; natural wax, such as candelilla wax, rice wax, Japan wax, beeswax, lanolin, montan wax, carnauba wax, ceresin wax, paraffin wax, microcrystalline wax, beef tallow, coconut oil, etc.; polyethylene wax, derivatives of stearic acid, etc.; and Fischer Tropsch wax.

The metallic soap and the wax may be used alone or in combination of two or more.

The surfactant may include those known in the art, and examples thereof may include alkali metal salts of sulfosuccinic acid, alkali metal salts of alkylbenzenesulfonic acid, sodium salts of laurylalcoholsulfuric acid ester, etc.

The surfactant may be used alone or in combination of two or more.

The defoaming agent may include those known in the art, and examples thereof may include high-grade alcohol-type, fatty acid ester-type, oil-type, silicone-type, polyether-type, modified hydrocarbon oil-type, paraffin-type, etc.

The defoaming agent may be used alone or in combination of two or more.

In the mixed dispersion composition, the dispersant may include those known in the art, and examples thereof may include sodium polyacrylate, polyvinylalcohol (having various degrees of saponification and polymerization, and pH values), carboxymethylcellulose, hydroxyethylcellulose, polyacrylamide, starch, styrene-maleic anhydride copolymer ammonium salts, etc.

In the mixed dispersion composition, the dispersant may be used alone or in combination of two or more.

The water resistance improver may include those known in the art, and examples thereof may include 1,1,3-tris(2-methyl-4-hydroxy-5-cyclohexylphenyl)butane, 1,1,3-tris(2-methyl-4-hydroxy-5-tert-butylphenyl)butane, 4-benzyloxy-4'-2,3-propoxydiphenylsulfone, etc.

The water resistance improver may be used alone or in combination of two or more.

The light resistance improver may include those known in the art, and is exemplified by a benzotriazole-type UV absorber. Specific examples thereof may include 2-(2-hydroxy-5-methylphenyl)benzotriazole, 2-(2-hydroxy-3-tert-butyl-5-methylphenyl)-5-chlorobenzotriazole, 2,2-methylenebis[4-(1,1,3,3-tetramethylbutyl)-6-(2H-benzotriazol-2-yl)phenol], microcapsulated 2-(2-hydroxy-3-dodecyl-5-methylphenyl)benzotriazole, etc.

The light resistance improver may be used alone or in combination of two or more.

<Thermosensitive Recording Medium>

According to the present invention, the thermosensitive recording medium is characterized in that it includes a thermosensitive recording layer formed by applying the mixed dispersion composition according to the present invention on a support. The applied mixed dispersion composition is typically dried.

The support may include those known in the art, and examples thereof may include synthetic paper; paper except for the synthetic paper, such as neutral paper, acidic paper, etc.; a plastic sheet; and a nonwoven fabric.

Examples of a method of applying the mixed dispersion composition on the support may include a method of using a variety of coaters, such as an air knife coater, a blade coater, a bar coater, a rod coater, a gravure coater, a curtain coater, a wire bar, etc.

Although varying depending on the kind of thermosensitive recording medium, the amount of the mixed dispersion composition applied on the support may be preferably in the range of 2.0~10.0 g/m$^2$ based on a dry-weight (solid content).

In order to increase the color-developing sensitivity, the thermosensitive recording medium may further include an undercoat layer (an intermediate layer) between the thermosensitive recording layer and the support.

The undercoat layer may be composed mainly of a pigment or organic hollow particles and an adhesive.

In the undercoat layer, the pigment preferably has high oil absorption capability, and examples thereof may include calcined kaolin, magnesium carbonate, amorphous silica, aluminum silicate, magnesium silicate, calcium silicate, calcium carbonate, urea-formalin resin filler, other porous pigments, etc.

The organic hollow particles may include homopolymers or copolymers of any monomer of vinyl chloride, vinylidene chloride, vinyl acetate, methyl acrylate, ethyl acrylate, methyl methacrylate, acrylonitrile, styrene, etc.

In the undercoat layer, examples of the adhesive may include water-soluble polymers such as gelatin, casein, starch and derivatives thereof, methylcellulose, ethylcellulose, hydroxyethylcellulose, carboxy methylcellulose, methoxy cellulose, completely (or partially) saponified polyvinylalcohol, carboxy-modified polyvinylalcohol, acetoacetyl-modified polyvinylalcohol, silicon-modified polyvinylalcohol, acrylamide-ethylacrylate copolymer, styrene-maleic anhydride copolymer, etc.; and hydrophobic polymers such as styrene-butadiene-type resin, styrene-acrylic resin, vinylacetate resin, acrylic resin, etc.

A method of forming the undercoat layer is not particularly limited, and, for example, may be the same as the method of forming the thermosensitive recording layer as above.

In order to prevent undesired color development due to friction, scratching, etc. and loss of the color-developed records due to a plasticizer, the thermosensitive recording medium may further include a protective layer on the thermosensitive recording layer.

The protective layer is composed mainly of a film-forming adhesive, a pigment, etc., and may include, as optional component, UV absorber-containing microcapsules, a fine UV absorber, etc. When such a protective layer is provided, yellowing of the surface due to light or degradation of the color-developed records may be significantly prevented. The protective layer may include, in addition to the above optional component, a fluorescent dye, a lubricant, a colorant, etc.

The protective layer enhancing printing suitability, ink pad suitability, writing suitability, etc. may be exemplified.

Examples of the film-forming adhesive may include carboxy-modified polyvinylalcohol, acetoacetyl-modified polyvinylalcohol, silicon-modified polyvinylalcohol, diacetone-modified polyvinylalcohol, etc.

When the protective layer is formed using such an adhesive, an additional crosslinking agent is preferably used to further increase water resistance of the protective layer. Examples of the crosslinking agent may include a dialdehyde-type compound such as glyoxal, dialdehyde starch, etc.; a polyamine-type compound such as polyethyleneimine, etc.; an epoxy-type compound; polyamide resin; melamine resin; boric acid; borax; and magnesium chloride.

In the protective layer, the pigment and the UV absorber may be the same as the pigment and the UV absorber in the mixed dispersion composition.

In the protective layer, each of the adhesive, pigment, UV absorber, fluorescent dye, lubricant, colorant, etc. may be used alone or in combination of two or more.

A method of forming the protective layer is not particularly limited, but may be, for example, the same as the method of forming the thermosensitive recording layer as above.

The amount of the composition applied to form the protective layer is preferably 0.5~15 g/m$^2$, and more preferably 1~8 g/m$^2$ based on a dry-weight (solid content). If the applied amount is less than 0.5 g/m$^2$, functionality of the protective layer cannot be exhibited. On the other hand, the applied amount exceeds 15 g/m$^2$, color-developing sensitivity of the thermosensitive recording medium may deteriorate.

The thermosensitive recording medium may further include, on the protective layer, a layer containing a water-soluble, water-dispersible, election-beam curable or UV curable resin to enhance gloss thereof, etc.

The thermosensitive recording medium is configured such that on the other side of the support (the side on which the thermosensitive recording layer is not formed), the same protective layer as above may be provided, or an adhesive paper or an adhesive layer composed mainly of a natural rubber-type adhesive, acryl resin-type adhesive, styrene isoprene block copolymer- or two-component crosslinkable acrylic resin-type adhesive may be provided.

For the thermosensitive recording medium including the adhesive layer, a barrier layer may be further provided between the support and the adhesive layer to enhance the storability thereof.

The thermosensitive recording medium may further include a magnetic recording layer on the other side of the support so as to function as a thermosensitive and magnetic recording medium.

The thermosensitive recording medium may be subjected to smoothing treatment such as supercalender treatment, etc. after the formation of individual layers.

EXAMPLES

A better understanding of the present invention may be obtained via the following examples which are set forth to illustrate, but are not to be construed as limiting the present invention.

<Preparation of Sensitizer Particle Dispersion>

Example 1

In a 1000 ml SUS separable flask equipped with a stirrer, a condenser and a thermometer, 19.5 mass parts of 1,2-bis(phenoxy)ethane, and 45.5 mass parts of stearic acid amide (「Fatty Acid Amide S」, made by Kao) were placed and co-melted by heat at 98° C. and thus unified. The total amount of the co-melted mixture thus obtained was added with 59.8 mass parts of a 10 mass % aqueous solution of polyvinylalcohol (「PVA217EE」, made by Kuraray), 0.46 mass parts of sodium dialkylsulfosuccinate (「Pelex TR」, concentration: 70 mass %, made by Kao) and 134.7 mass parts of water, after which the temperature of the separable flask was increased up to 98° C., and the mixture was stirred at 98° C. for 5 min (700 rpm). Subsequently, the separable flask was removed, attached to「T.K.HOMOMIXER」made by Tokushu Kika Kogyo (PRIM:IX Corporation), and provided with a polytetrafluoroethylene plate as a lid for preventing escape of vapor from the mixture in the separable flask during emulsification at high temperature, followed by emulsifying the mixture at 99~100° C. at a revolution number of 10000 rpm for 1.5 min, thus obtaining an emulsified dispersion.

Thereafter, in a 1000 ml pot equipped with a stirrer, 30 mass parts of ice, 10 mass parts of water, and 0.2 mass parts of a 10 mass % aqueous solution of polyvinylalcohol (「PVA217EE」, made by Kuraray) were placed, and the pot was cooled with ice water. While the mixture in the pot was stirred, the total amount of the emulsified dispersion with the temperature of 98° C. was carefully introduced into the pot such that the temperature thereof became 30° C. or less. In the meantime, the cooling rate of the introduced emulsified dispersion was 10° C./min or more. Then, 2 hr stirring was further conducted so that the temperature of the mixture in the pot was 30° C. or less, thus completing the crystallization of sensitizer particles.

Thereafter, screening with a testing sieve (opening size: 20 μm) was performed, on which solids hardly remained on the sieve.

Thereby, a sensitizer particle dispersion composed mainly of stearic acid amide and having good fluidity was obtained (yield: 280 mass parts, solid content: 23.5 mass %). In the sensitizer particle dispersion, the average particle diameter of the sensitizer particles was 1.5 μm.

Example 2

In a 1000 ml SUS separable flask equipped with a stirrer, a condenser and a thermometer, 24 mass parts of 1,2-bis(phenoxy)ethane and 56 mass parts of stearic acid amide (「Fatty Acid Amide S」, made by Kao) were placed and co-melted by heat at 98° C. and thus unified. The total amount of the co-melted mixture thus obtained was added with 73.6 mass parts of a 10 mass % aqueous solution of polyvinylalcohol (「PVA205」, made by Kuraray), 1.14 mass parts of sodium dialkylsulfosuccinate (「Pelex TR」, concentration: 70 mass %, made by Kao) and 91.36 mass parts of water, after which the temperature of the separable flask was increased up to 98° C. and the mixture was then stirred at 98° C. for 5 min (700 rpm). Subsequently, the separable flask was removed, attached to「T.K.HOMOMIXER」made by Tokushu Kika Kogyo (PRIMIX Corporation), and provided with a polytetrafluoroethylene plate as a lid for preventing escape of vapor from the mixture in the separable flask during emulsification at high temperature, followed by emulsifying the mixture at 99~100° C. at a revolution number of 14000 rpm for 1.5 min, thus obtaining an emulsified dispersion.

Thereafter, in a 1000 ml pot equipped with a stirrer, 30 mass parts of ice, 10 mass parts of water, and 0.2 mass parts of a 10 mass % aqueous solution of polyvinylalcohol (「PVA205」, made by Kuraray) were placed, and the pot was cooled with ice water. While the mixture in the pot was stirred, the total amount of the emulsified dispersion with the temperature of 99~100° C. was carefully introduced into the pot such that the temperature thereof became 30° C. or less. In the meantime, the cooling rate of the introduced emulsified dispersion was 10° C./min or more. Then, 2 hr stirring was further conducted so that the temperature of the mixture in the pot was 30° C. or less, thus completing the crystallization of sensitizer particles.

Thereafter, screening with a testing sieve (opening size: 20 μm) was performed, on which solids hardly remained on the sieve.

Thereby, a sensitizer particle dispersion composed mainly of stearic acid amide and having good fluidity was obtained (yield: 270 mass parts, solid content: 30.4 mass %). In the sensitizer particle dispersion, the average particle diameter of the sensitizer particles was 0.8 μm.

Examples 3~8

Sensitizer particle dispersions were prepared in the same manner as in Example 2, with the exception that the kind of the other sensitizer to be mixed with stearic acid amide and the amounts thereof were changed as shown in Table 1 below. The melting points of co-melted and unified sensitizer are also given in Table 1. Furthermore, fluidity, yield and solid content of the obtained sensitizer particle dispersions and the average particle diameter of the sensitizer particles are shown in Table 2 below,

TABLE 1

| | Mixed sensitizer | | |
|---|---|---|---|
| | Kind | Amount (mass part) | Melting point (° C.) of co-melted and unified sensitizer |
| Ex. 1 | Stearic acid amide | 45.5 | 94.2 |
| | 1,2-bis(phenoxy)ethane | 19.5 | |
| Ex. 2 | Stearic acid amide | 56 | 94.2 |
| | 1,2-bis(phenoxy)ethane | 24 | |
| Ex. 3 | Stearic acid amide | 56 | 95.5 |
| | 1,2-bis(3-methylphenoxy)ethane | 24 | |
| Ex. 4 | Stearic acid amide | 64 | 99.9 |
| | 1,2-bis(4-methylphenoxy)ethane | 16 | |
| Ex. 5 | Stearic acid amide | 72 | 99.4 |

TABLE 1-continued

| | Mixed sensitizer | | |
|---|---|---|---|
| | Kind | Amount (mass part) | Melting point (° C.) of co-melted and unified sensitizer |
| | p-benzylbiphenyl | 8 | |
| Ex. 6 | Stearic acid amide | 56 | 97.8 |
| | di-p-methylbenzyl oxalate | 24 | |
| Ex. 7 | Stearic acid amide | 56 | 95.8 |
| | β-naphthylbenzylether | 24 | |
| Ex. 8 | Stearic acid amide | 56 | 98.9 |
| | Diphenylsulfone | 24 | |

TABLE 2

| | Sensitizer Particle dispersion | | | Sensitizer Particles |
|---|---|---|---|---|
| | Fluidity | Yield (mass part) | Solid content (mass %) | Average particle diameter (μm) |
| Ex. 1 | Good | 280 | 23.5 | 1.5 |
| Ex. 2 | Good | 270 | 30.4 | 0.8 |
| Ex. 3 | Good | 272 | 30.3 | 0.8 |
| Ex. 4 | Good | 270 | 30.5 | 0.8 |
| Ex. 5 | Good | 268 | 30.4 | 0.8 |
| Ex. 6 | Good | 271 | 30.4 | 0.8 |
| Ex. 7 | Good | 270 | 30.3 | 0.8 |
| Ex. 8 | Good | 269 | 30.5 | 0.8 |

<Preparation of Co-Melted Sensitizer Mixture>

Comparative Example 1

70 mass parts of stearic acid amide (「Fatty Acid Amide S」, made by Kao) was mixed with 30 mass parts of 1,2-bis(phenoxy)ethane, and the resulting mixture was co-melted by heat up to 100° C., cooled to solidify the heated and co-melted mixture and then milled using a mortar, thus obtaining a co-melted sensitizer mixture.

Then, in a 400 ml pot of a sand grinder (「Model TSG4H」, made by Igarashi Kikai Seizo), 10 mass parts of the obtained, co-melted sensitizer mixture, 2 mass parts of a 10 mass % aqueous solution of polyvinylalcohol (「PVA205」, made by Kuraray), 2 mass parts of a 10 mass % aqueous solution of cellulose ether (「Methocel E3」, made by Dow), 0.07 mass parts of sodium dialkylsulfosuccinate (「Pelex TR」, concentration: 70 mass %, made by Kao), 0.2 mass parts of a 5 mass % aqueous solution of a defoaming agent (「Nopco 1407-K」; , made by San Nopco) and 19 mass parts of water were placed, and the powder mixture was well permeated in the water by a spatula and then allowed to stand for 2 hr.

Thereafter, 70 mass parts of glass beads (「EGB501MM (glass bead diameter: 0.85~1.18 mm)」, made by Potters Ballotini) was placed in the pot, and the pot was then equipped with a 3-stage blade, after which milling was initiated at a revolution number of 1050 rpm while water at 20° C. was circulated through a pot jacket. 1 hr after the initiation of milling, the particle diameter of the sensitizer particles of the dispersion was measured using a particle size analyzer (「SALD-2000J」, made by Shimadzu). The average particle diameter thereof was determined to be 7 μm. However, in the case where milling was further conducted, 2 hr after the initiation of milling, the dispersion has no fluidity and thus became mousse-like.

The sensitizer particle dispersion composed mainly of stearic acid amide could not be prepared by the method different from the method of the invention.

Comparative Example 2

In a 1000 ml SUS separable flask equipped with a stirrer, a condenser and a thermometer, 24 mass parts of 1,2-bis(phenoxy)ethane and 56 mass parts of stearic acid amide (「Fatty Acid Amide S」, made by Kao) were placed and co-melted by heat at 98° C. and thus unified. The total amount of the co-melted mixture thus obtained was added with 73.6 mass parts of a 10 mass % aqueous solution of polyvinylalcohol (「PVA205」, made by Kuraray), 1.14 mass parts of sodium dialkylsulfosuccinate (「Pelex TR」, concentration: 70 mass %, made by Kao) and 91.36 mass parts of water, after which the temperature of the separable flask was increased up to 98° C., and the mixture was stirred at 98° C. for 5 min (700 rpm). Subsequently, the separable flask was removed, attached to 「T.K.HOMOMIXER」 made by Tokushu Kika Kogyo (PRIMIX Corporation), and provided with a polytetrafluoroethylene plate as a lid for preventing escape of vapor from the mixture in the separable flask during emulsification at high temperature, after which the mixture was emulsified at 99~100° C. at a revolution number of 1.4000 rpm for 1.5 min, thus obtaining an emulsified dispersion.

Thereafter, in a 1000 ml pot equipped with a stirrer, 40 mass parts of water, and 0.2 mass parts of a 10 mass % aqueous solution of polyvinylalcohol (「PVA205」, made by Kuraray) were placed. While the mixture in the pot was stirred under the condition that the pot was not cooled, the emulsified dispersion with the temperature of 98° C. was introduced into the pot. Since the pot was not cooled, the temperature of the mixture in the pot was increased to 65° C., and thus the mixture became mousse-like and could not be stirred. Using a microscope (「BH-2」, ×1000, made by Olympus), such a product was observed to be needle-shaped giant crystals, with few spherical particles having a particle diameter of about 1 μm, wherein the emulsified state was broken. The solid content of the product was 30.5 mass %.

Since the emulsified dispersion was not quenched, the sensitizer particle dispersion composed mainly of stearic acid amide could not be prepared.

<Preparation of Second Mixed Dispersion>

Preparative Example 1

110 mass parts of the sensitizer particle dispersion obtained in Example 2, 67 mass parts of 4,4'-dihydroxydiphenylsulfone, 73 mass parts of water, and 0.5 mass parts of a 5 mass % aqueous solution of a defoaming agent (「Nopco 1407-K」, made by San Nopco) were placed in a 1000 ml pot of a sand grinder (「Model TSG4H」, made by Igarashi Kikai Seizo), and the powder mixture was well permeated in the water by a spatula and then allowed to stand for 2 hr.

Thereafter, 500 mass parts of glass beads (「EGB501MM (glass bead diameter: 0.85~1.18 mm)」, made by Potters Ballotini) were placed in the pot, and the pot was then equipped with a 3-stage blade, after which milling was initiated at a revolution number of 1000 rpm while water at 20° C. was circulated through a pot jacket. The particle diameter of the second particles of the dispersion was measured over time using a particle size analyzer (「SALD-2000J」, made by Shimadzu). 45 min after the initiation of the milling process, the average particle diameter thereof was confirmed to be 1.0 μm.

The dispersion was screened with a testing sieve (opening size: 20 μm), thus obtaining a second mixed dispersion (yield: 140 mass parts, solid content: 40.5 mass %). In the second mixed dispersion, the average particle diameter of the second particles was 1.0 μm.

Preparative Example 2

55 mass parts of the sensitizer particle dispersion obtained in Example 2, 67 mass parts of 4,4'-dihydroxydiphenyl sulfone, 128 mass parts of water, and 0.5 mass parts of a 5 mass % aqueous solution of a defoaming agent (「Nopco 1407-K」, made by San Nopco) were placed in a 1000 ml pot of a sand grinder (「Model TSG4H」, made by Igarashi Kikai Seizo), and the powder mixture was well permeated in the water by a spatula and then allowed to stand for 2 hr.

Thereafter, 500 mass parts of glass beads (「EGB501MM (glass bead diameter: 0.85~1.18 mm)」, made by Potters Ballotini) were placed in the pot, and the pot was then equipped with a 3-stage blade, after which milling was initiated at a revolution number of 1000 rpm while water at 20° C. was circulated through a pot jacket. The particle diameter of the second particles of the dispersion was measured over time using a particle size analyzer (「SALD-2000J」, made by Shimadzu). 45 min after the initiation of the milling process, the average particle diameter thereof was 1.0 μm.

The dispersion was screened with a testing sieve (opening size: 20 μm), thus obtaining a second mixed dispersion (yield: 145 mass parts, solid content: 33.5 mass %). In the second mixed dispersion, the average particle diameter of the second particles was 1.0 μm.

<Preparation of First Mixed Dispersion>

Preparative Example 3

164.5 mass parts of the sensitizer particle dispersion obtained in Example 2, 50 mass parts of 3-N,N-dibutylamino-6-methyl-7-anilinofluoran, 35.5 mass parts of water, and 0.5 mass parts of a 5 mass % aqueous solution of a defoaming agent (「Nopco 1407-K」, made by San Nopco) were placed in a 1000 ml pot of a sand grinder (「Model TSG4H」, made by Igarashi Kikai Seizo), and the powder mixture was well permeated in the water by a spatula and then allowed to stand for 2 hr.

Thereafter, 500 mass parts of glass beads (「EGB501MM (glass bead diameter: 0.85~1.18 mm)」, made by Potters Ballotini) were placed in the pot, and the pot was then equipped with a 3-stage blade, after which milling was initiated at a revolution number of 1000 rpm while water at 20° C. was circulated through a pot jacket. The particle diameter of the first particles of the dispersion was measured over time using a particle size analyzer (「SALD-2000J」, made by Shimadzu). 45 min after the initiation of the milling process, the average particle diameter thereof was 1.0 μm.

The dispersion was screened with a testing sieve (opening size: 20 μm), thus obtaining a first mixed dispersion (yield: 145 mass parts, solid content: 40.4 mass %). In the first mixed dispersion, the average particle diameter of the first particles was 1.0 μm.

Preparative Example 4

82.3 mass parts of the sensitizer particle dispersion obtained in Example 2, 50 mass parts of 3-N,N-dibutylamino-6-methyl-7-anilinofluoran, 117.7 mass parts of water, and 0.5 mass parts of a 5 mass % aqueous solution of a defoaming agent (「Nopco 1407-K」, made by San Nopco) were placed in a 1000 ml pot of a sand grinder (「Model TSG4H」, made by Igarashi Kikai Seizo), and the powder mixture was well permeated in the water by a spatula and then allowed to stand for 2 hr.

Thereafter, 500 mass parts of glass beads (「EGB501MM (glass bead diameter: 0.85~1.18 mm)」, made by Potters Ballotini) were placed in the pot, and the pot was then equipped with a 3-stage blade, after which milling was initiated at a revolution number of 1000 rpm while water at 20° C. was circulated through a pot jacket. The particle diameter of the first particles of the dispersion was measured over time using a particle size analyzer (「SALD-2000J」, made by Shimadzu). 45 min after the initiation of the milling process, the average particle diameter thereof was 1.0 μm.

The dispersion was screened with a testing sieve (opening size: 20 μm), thus obtaining a first mixed dispersion (yield: 150 mass parts, solid content: 30.0 mass %). In the first mixed dispersion, the average particle diameter of the first particles was 1.0 μm.

<Preparation of Wet-Milled Dye Dispersion>

Preparative Example 5

Using a sand grinder (「Model TSG4H」, made by Igarashi Kikai Seizo), in 45 mass parts of sulfone-modified polyvinylalcohol (「Gohseran L-3266 (5 mass % aqueous solution)」, made by Nippon Synthetic Chemical Industry), 30 mass parts of 3-N,N-dibutylamino-6-methyl-7-anilinofluoran was milled, giving a dispersion where the average particle diameter of dye particles was 1.0 μm. This dispersion was screened with a testing sieve (opening size: 20 μm), thereby obtaining a wet-milled dye dispersion.

<Preparation of Wet-Milled Color Developer Dispersion>

Preparative Example 6

Using a sand grinder (「Model TSG4H」, made by Igarashi Kikai Seizo), in 45 mass parts of a 5 mass % aqueous solution of cellulose ether (「Methocel E3」, made by Dow), 30 mass parts of 4,4'-dihydroxydiphenylsulfone was milled, giving a dispersion where the average particle diameter of color developer particles was 1.0 μm. Also, this dispersion was screened with a testing sieve (opening size: 20 μm), thereby obtaining a wet-milled color developer dispersion.

<Preparation of Pigment Dispersion Solution>

Preparative Example 7

Using a HOMO DISPER (「TK HOMO DISPER-L」, made by Tokushu Kika Kogyo), 31) mass parts of a pigment (hard calcium carbonate, 「Unibar 70」, made by Shiraishi Calcium), 69 mass parts of water, and 1.0 mass part of a 40 mass % aqueous solution of sodium hexametaphosphate were stirred at 5000 rpm for 5 min, giving a pigment dispersion solution.

<Preparation of Mixed Dispersion Composition>

Example 9

16.2 mass parts of the sensitizer particle dispersion obtained in Example 1 was diluted with 2.8 mass parts of water, thus obtaining a sensitizer dispersion solution with the concentration of 20 mass % (1).

Thereafter, 19 mass parts of the sensitizer dispersion solution (1), 9.5 mass parts of the wet-milled dye dispersion of Preparative Example 5, 19 mass parts of the wet-milled color developer dispersion of Preparative Example 6, 30 mass parts of the pigment dispersion solution of Preparative Example 7, 10.6 mass parts of, as a lubricant dispersion solution, an zinc stearate emulsion (「Hydrin Z-7」 (concentration: 30 mass %), made by Chukyo Yushi), and 21.6 mass parts of a 5 mass % aqueous solution of polyvinylalcohol (「PVA105」, made by Kuraray) were mixed, thus obtaining a mixed dispersion composition.

Example 10

12.6 mass parts of the sensitizer particle dispersion obtained in Example 2 was diluted with 6.4 mass parts of water, thus obtaining a sensitizer dispersion solution with the concentration of 20 mass % (2).

Thereafter, a mixed dispersion composition was obtained in the same manner as in Example 9, with the exception that 19 mass parts of the sensitizer dispersion solution (2) was used, instead of 19 mass parts of the sensitizer dispersion solution (1).

Example 11

12.6 mass parts of the sensitizer particle dispersion obtained in Example 3 was diluted with 6.4 mass parts of water, thus obtaining a sensitizer dispersion solution with the concentration of 20 mass % (3).

Thereafter, a mixed dispersion composition was obtained in the same manner as in Example 9, with the exception that 19 mass parts of the sensitizer dispersion solution (3) was used, instead of 19 mass parts of the sensitizer dispersion solution (1).

Example 12

12.6 mass parts of the sensitizer particle dispersion obtained in Example 4 was diluted with 6.4 mass parts of water, thus obtaining a sensitizer dispersion solution with the concentration of 20 mass % (4).

Thereafter, a mixed dispersion composition was obtained in the same manner as in Example 9, with the exception that 19 mass parts of the sensitizer dispersion solution (4) was used, instead of 19 mass parts of the sensitizer dispersion solution (1).

Example 13

12.6 mass parts of the sensitizer particle dispersion obtained in Example 5 was diluted with 6.4 mass parts of water, thus obtaining a sensitizer dispersion solution with the concentration of 20 mass % (5).

Thereafter, a mixed dispersion composition was obtained in the same manner as in Example 9, with the exception that 19 mass parts of the sensitizer dispersion solution (5) was used, instead of 19 mass parts of the sensitizer dispersion solution (1).

Example 14

12.6 mass parts of the sensitizer particle dispersion obtained in Example 6 was diluted with 6.4 mass parts of water, thus obtaining a sensitizer dispersion solution (6) with the concentration of 20 mass %.

Thereafter, a mixed dispersion composition was obtained in the same manner as in Example 9, with the exception that 19 mass parts of the sensitizer dispersion solution (6) was used, instead of 19 mass parts of the sensitizer dispersion solution (1).

Example 15

12.6 mass parts of the sensitizer particle dispersion obtained in Example 7 was diluted with 6.4 mass parts of water, thus obtaining a sensitizer dispersion solution with the concentration of 20 mass % (7).

Thereafter, a mixed dispersion composition was obtained in the same manner as in Example 9, with the exception that 19 mass parts of the sensitizer dispersion solution (7) was used, instead of 19 mass parts of the sensitizer dispersion solution (1).

Example 16

12.6 mass parts of the sensitizer particle dispersion obtained in Example 8 was diluted with 6.4 mass parts of water, thus obtaining a sensitizer dispersion solution with the concentration of 20 mass % (8).

Thereafter, a mixed dispersion composition was obtained in the same manner as in Example 9, with the exception that 19 mass parts of the sensitizer dispersion solution (8) was used, instead of 19 mass parts of the sensitizer dispersion solution (1).

Example 17

28.4 mass parts of the second mixed dispersion obtained in Preparative Example 1 was diluted with 0.1 mass parts of water, thus obtaining a second mixed dispersion solution.

Thereafter, 28.5 mass parts of the second mixed dispersion solution, 9.5 mass parts of the wet-milled dye dispersion of Preparative Example 5, 30 mass parts of the pigment dispersion solution of Preparative Example 7, 10.6 mass parts of, as a lubricant dispersion solution, a zinc stearate emulsion (「Hydrin Z-7」 (concentration: 30 mass %), made by Chukyo Yushi), and 21.6 mass parts of a 5 mass % aqueous solution of polyvinylalcohol (「PVA105」, made by Kuraray) were mixed, giving a mixed dispersion composition.

Example 18

19 mass parts of the first mixed dispersion obtained in Preparative Example 3 was diluted with 9.5 mass parts of water, thus obtaining a first mixed dispersion solution.

Thereafter, 28.5 mass parts of the first mixed dispersion solution, 19 mass parts of the wet-milled color developer dispersion of Preparative Example 6, 30 mass parts of the pigment dispersion solution of Preparative Example 7, 10.6 mass parts of, as a lubricant dispersion solution, a zinc stearate emulsion (「Hydrin Z-7」 (concentration: 30 mass %), made by Chukyo Yushi), and 21.6 mass parts of a 5 mass % aqueous solution of polyvinylalcohol (「PVA105」, made by Kuraray) were mixed, giving a mixed dispersion composition.

Example 19

19 mass parts of the first mixed dispersion obtained in Preparative Example 4 was diluted with 9.6 mass parts of water, thus obtaining a first mixed dispersion solution.

Thereafter, 28.6 mass parts of the first mixed dispersion solution, 28.4 mass parts of the second mixed dispersion of Preparative Example 2, 30 mass parts of the pigment dispersion solution of Preparative Example 7, 10.6 mass parts of, as a lubricant dispersion solution, a zinc stearate emulsion (「Hydrin Z-7」 (concentration: 30 mass %), made by Chukyo Yushi), and 21.6 mass parts of a 5 mass % aqueous solution of polyvinylalcohol (「PVA105」, made by Kuraray) were mixed, giving a mixed dispersion composition.

<Preparation of Thermosensitive Recording Medium>

Example 20

On one side of 64 g/m$^2$ high-quality neutral paper, the mixed dispersion composition of Example 9 was applied in an amount of 5 g/m$^2$ based on a dry-weight using a wire bar coater, and then dried, thereby forming a thermosensitive recording layer, resulting in a thermosensitive recording medium. The thermosensitive recording medium was finally subjected to supercalender treatment.

Examples 21~30

Thermosensitive recording media subjected to supercalender treatment were obtained in the same manner as in Example 20, with the exception that the mixed dispersion compositions of Examples 10~19 were used, respectively, instead of the mixed dispersion composition of Example 9.

Comparative Example 3

1.8 mass parts of a 1,2-bis(phenoxy)ethane dispersion (「KS-235-S」, average particle diameter: 1.2 μm, concentration: 50 mass %, made by Sanko) and 8.2 mass parts of a stearic acid amide dispersion (「Himicron L-271」, average particle diameter: 0.5 μm, concentration: 25 mass %, made by Chukyo Yushi) were mixed. This mixture was diluted with 5.2 mass parts of water, thus obtaining a mixed sensitizer dispersion solution with the concentration of 20 mass %.

Thereafter, a comparative mixed dispersion composition was obtained in the same manner as in Example 9, with the exception that 19 mass parts of the above obtained, mixed sensitizer dispersion solution was used, instead of 19 mass parts of the sensitizer dispersion solution (1).

Thereafter, a comparative thermosensitive recording medium subjected to supercalender treatment was obtained in the same manner as in Example 20, with the exception that the obtained, comparative mixed dispersion composition was used instead of the mixed dispersion composition of Example 9.

The processes as above are summarized in Table 3 below.

TABLE 3

| Sensitizer particle dispersion | Wet-milled dye dispersion or 1$^{st}$ mixed dispersion | Wet-milled color developer dispersion or 2$^{nd}$ mixed dispersion | Mixed dispersion composition | Thermo-sensitive recording medium |
|---|---|---|---|---|
| Ex. 1 | Prep. Ex. 5 | Prep. Ex. 6 | Ex. 9 | Ex. 20 |
| Ex. 2 | | | Ex. 10 | Ex. 21 |
| Ex. 3 | | | Ex. 11 | Ex. 22 |
| Ex. 4 | | | Ex. 12 | Ex. 23 |
| Ex. 5 | | | Ex. 13 | Ex. 24 |
| Ex. 6 | | | Ex. 14 | Ex. 25 |
| Ex. 7 | | | Ex. 15 | Ex. 26 |
| Ex. 8 | | | Ex. 16 | Ex. 27 |

TABLE 3-continued

| Sensitizer particle dispersion | Wet-milled dye dispersion or 1st mixed dispersion | Wet-milled color developer dispersion or 2nd mixed dispersion | Mixed dispersion composition | Thermo-sensitive recording medium |
|---|---|---|---|---|
| (Ex. 2) | | Prep. Ex. 1 | Ex. 17 | Ex. 28 |
| (Ex. 2) | Prep. Ex. 3 | Prep. Ex. 6 | Ex. 18 | Ex. 29 |
| (Ex. 2) | Prep. Ex. 4 | Prep. Ex. 2 | Ex. 19 | Ex. 30 |

<Evaluation of Performance of Thermosensitive Recording Medium>

The thermosensitive recording medium obtained in each of the examples and comparative examples as above was subjected to a printing test under conditions of a printing voltage of 24 V and a printing cycle of 0.9 msec and 1.4 msec using a thermosensitive recording medium color-developing tester (「TH-PMD」, made by Ohkura Electric) with a thermosensitive head (Type KJT-256-8MGFI-ASH, made by Kyocera) of 1653Ω, and the following items were evaluated. The results are shown in Table 4 below. As used herein, the unit「sec」indicates「millisecond」.

(Evaluation Items)

(1) Surface and Print Density

Measurement was performed using a Macbeth densitometer (「Model RD-918」, made by Macbeth).

(2) Humidity Resistance

The thermosensitive recording medium was allowed to stand under conditions of a temperature of 40° C. and a humidity of 90% for 24 hr, and then measured for surface and print density in the same manner as in (1).

(3) Heat Resistance

The thermosensitive recording medium was allowed to stand at 60° C. for 24 hr without the control of humidity, and then measured for surface and print density in the same manner as in (1).

TABLE 4

| | Initial value | | | Humidity resistance | | Heat resistance | |
|---|---|---|---|---|---|---|---|
| | Surface | 0.9 msec | 1.4 msec | Surface | 1.4 msec | Surface | 1.4 msec |
| Ex. 20 | 0.06 | 0.44 | 1.13 | 0.07 | 0.94 | 0.08 | 0.99 |
| Ex. 21 | 0.06 | 0.45 | 1.15 | 0.07 | 0.98 | 0.08 | 1.09 |
| Ex. 22 | 0.06 | 0.42 | 1.11 | 0.07 | 0.94 | 0.08 | 1.05 |
| Ex. 23 | 0.06 | 0.42 | 1.12 | 0.07 | 0.96 | 0.08 | 1.03 |
| Ex. 24 | 0.06 | 0.41 | 1.10 | 0.07 | 0.93 | 0.08 | 1.06 |
| Ex. 25 | 0.06 | 0.42 | 1.13 | 0.07 | 0.94 | 0.08 | 1.06 |
| Ex. 26 | 0.06 | 0.43 | 1.14 | 0.07 | 0.95 | 0.08 | 1.04 |
| Ex. 27 | 0.06 | 0.45 | 1.15 | 0.07 | 0.98 | 0.08 | 1.09 |
| Ex. 28 | 0.06 | 0.43 | 1.14 | 0.07 | 0.94 | 0.08 | 1.05 |
| Ex. 29 | 0.06 | 0.42 | 1.13 | 0.07 | 0.95 | 0.08 | 1.04 |
| Ex. 30 | 0.06 | 0.43 | 1.14 | 0.07 | 0.96 | 0.08 | 1.05 |
| C. Ex. 3 | 0.06 | 0.34 | 1.06 | 0.07 | 0.91 | 0.08 | 0.94 |

As is apparent from these results, the thermosensitive recording media of Examples 20~30 had sufficiently high initial print density and superior humidity resistance and heat resistance. For the sensitizer particle dispersions used in these examples, the sensitizer particles composed mainly of stearic acid amide had a low melting point compared to when using particles of each of individual sensitizer components alone. Thus, even when the particle diameter was large, high solubility and excellent color-developing density resulted. Based on the results of Examples 20 and 21, the sensitizer particles having a small average particle diameter exhibited superior humidity resistance and heat resistance.

However, the thermosensitive recording medium of Comparative Example 3 had low print density.

As described hereinbefore, the present invention is useful in a thermosensitive recording medium.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of preparing a sensitizer particle dispersion for a thermosensitive recording medium composed mainly of stearic acid amide, comprising:

mixing stearic acid amide with another sensitizer other than stearic acid amide, at least one selected from the group consisting of 1,2-bis(phenoxy)ethane, 1,2-bis(3-methylphenoxy)ethane, 1,2-bis(4-methylphenoxy) ethane, p-benzylbiphenyl, di-p-methylbenzyl oxalate, β-naphthylbenzylether and diphenylsulfone at a mass ratio of 95:5~51:49, thus obtaining a mixture;

co-melting the obtained mixture by heat in emulsifier-dispersed water, so that the stearic acid amide and the other sensitizer are unified and emulsified into particles, or emulsifying a co-melted mixture of the stearic acid amide and the other sensitizer unified by co-melting the mixture by heat, into particles in emulsifier-dispersed water, thus obtaining an emulsified dispersion; and quenching the emulsified dispersion, thus crystallizing sensitizer particles from the emulsified particles.

2. The method of claim 1, wherein the quenched emulsified dispersion has a temperature of 50° C. or less.

3. A sensitizer particle dispersion for a thermosensitive recording medium composed mainly of stearic acid amide, characterized in that it is prepared by the method of claim 1.

4. A mixed dispersion composition for a thermosensitive recording layer, characterized in that it comprises the sensitizer particle dispersion of claim 3, a dye for a thermosensitive recording medium, and a color developer for a thermosensitive recording medium, which are mixed together.

5. The mixed dispersion composition of claim 4, which is configured such that a first mixed dispersion obtained by mixing the sensitizer particle dispersion of claim 3 and the dye for a thermosensitive recording medium and performing wet-milling, is mixed with a wet-milled dispersion of the color developer for a thermosensitive recording medium.

6. The mixed dispersion composition of claim 4, which is configured such that a second mixed dispersion obtained by mixing the sensitizer particle dispersion of claim 3 and the color developer for a thermosensitive recording medium and performing wet-milling, is mixed with a wet-milled dispersion of the dye for a thermosensitive recording medium.

7. The mixed dispersion composition of claim 4, which is configured such that a first mixed dispersion obtained by mixing the sensitizer particle dispersion of claim 3 and the dye for a thermosensitive recording medium and performing wet-milling, is mixed with a second mixed dispersion obtained by mixing the sensitizer particle dispersion of claim 3 and the color developer for a thermosensitive recording medium and performing wet-milling.

8. A thermosensitive recording medium, characterized in that it comprises a thermosensitive recording layer formed by applying the mixed dispersion composition of claim 4 on a support.

* * * * *